US009683414B1

(12) United States Patent
Arizmendi

(10) Patent No.: US 9,683,414 B1
(45) Date of Patent: Jun. 20, 2017

(54) CENTRALIZER AND LOCKING COLLAR

(71) Applicant: Centergenics, LLC, Spring, TX (US)

(72) Inventor: Napoleon Arizmendi, Magnolia, TX (US)

(73) Assignee: Centergenics, LLC, The Woodlands, TX (US)

( * ) Notice: Subject to any disclaimer, the term of this patent is extended or adjusted under 35 U.S.C. 154(b) by 154 days.

(21) Appl. No.: 14/485,478

(22) Filed: Sep. 12, 2014

Related U.S. Application Data

(60) Provisional application No. 61/877,913, filed on Sep. 13, 2013.

(51) Int. Cl.
*E21B 17/10* (2006.01)

(52) U.S. Cl.
CPC ..... *E21B 17/1078* (2013.01)

(58) Field of Classification Search
None
See application file for complete search history.

(56) References Cited

U.S. PATENT DOCUMENTS 2,671,641 A * 3/1954 Hinkle ..... E21B 17/1085 175/325.5
2,901,269 A 8/1959 Rickard
2,907,189 A * 10/1959 Flieg ..... F16D 41/206 464/160
2,936,625 A * 5/1960 Heiseler ..... F16B 7/20 192/223.4
4,131,167 A * 12/1978 Richey ..... E21B 17/1078 175/323
4,245,709 A * 1/1981 Manuel ..... E21B 17/1078 175/325.5
4,438,822 A * 3/1984 Russell ..... E21B 17/1078 175/325.5
5,335,723 A 8/1994 Mouton
5,575,333 A 11/1996 Lirette et al.
5,794,988 A * 8/1998 Gill ..... F16L 37/088 285/305
5,860,760 A 1/1999 Kirk
6,186,560 B1 * 2/2001 Gill ..... F16L 21/08 285/305
6,435,275 B1 8/2002 Kirk et al.
6,533,034 B1 3/2003 Barger
8,668,007 B2 3/2014 Casassa et al.
2002/0112853 A1 8/2002 Buytaert
2010/0218956 A1 * 9/2010 Buytaert ..... E21B 17/1028 166/382
2011/0114338 A1 5/2011 Casassa et al.
2014/0000900 A1 1/2014 Leiper et al.

FOREIGN PATENT DOCUMENTS

WO 2012095671 A2 7/2012

OTHER PUBLICATIONS

International Searching Authority, Internaitonal Search Report & Written Opinion for Application PCT/US2016/058170 mailed Feb. 17, 2017, 12 pgs.

* cited by examiner

*Primary Examiner* — Caroline Butcher

(57) ABSTRACT

A lock capable of self-locking onto a tubular and onto another centralizer. The lock collar being of the type used in production strings of tubulars in the oilfield. The lock collar relates to mechanisms such as stop rings for centralizers commonly used in downhole applications to prevent axial and rotational movement of centralizers mounted on the tubing or casing outer surface.

10 Claims, 16 Drawing Sheets

VIEW 'E-E'

SECTON 'H-H'

CENTRALIZER AND LOCKING COLLAR

FIELD OF THE INVENTION

The present invention is directed to a centralizer capable of self-locking onto a tubular, the centralizer being of the type used in production strings of tubulars in the oilfield. More specifically, the invention relates to mechanisms such as stop rings for centralizers commonly used in downhole applications to prevent axial and rotational movement of centralizers mounted on the tubing or casing outer surface.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Within the area of subterranean drilling, centralizers are typically used to keep the casing centered during a cement job to prevent cementing the pipe against a side of the well. It is also desirable to reduce drag while installing tubing/casing into the wellbore, or isolating tubing OD from casing ID. Additionally, in long horizontal sections, the horizontal sections may be longer than the vertical sections. As a result, there is often insufficient hook load for gravitational insertion of the tubular section, making it necessary to push the tubular into the well. Rotating the pipe can ease installation.

In some cases, equipment such as sand screens and packers and valves are installed in a horizontal section of the well where there is potential for damage and/or significant amount of drag. It is desirable to not rotate screened sections in the system. To overcome this problem, swivel tools are located above the screens to prevent rotation of that section.

Various types of centralizers and stop rings or stop collars are used to protect the equipment and reduce drag. To further reduce drag and allow equipment to be installed in longer horizontal sections, there is need for the centralizer to withstand high axial loads and be rotationally locked to the tubing/casing OD. By locking the centralizer to the pipe OD, the equipment can be rotated to break out of tight spots and reduce the load required to push the equipment into the horizontal section.

Currently, stop rings/collars are anchored on the pipe OD by applying torque to two rings to energize a third C-ring type component, or installing set screws, hammering in wires or nails into a sleeve to produce friction between the mating parts. Some of these methods are considered a safety hazard and so there is desire for equipment to be safe and simple to install.

Thus there remains a need for a centralizer that can lock itself onto the tubular that does not require the use of stop rings, special torqueing tools, or small fasteners, and that reliably prevents axial movement of the centralizer. It is also desirable to prevent rotation movement of the centralizer relative to the tubular.

SUMMARY OF THE INVENTION

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The concept of this invention is to provide a centralizer that resists rotation about the tubular and has a high resistance to axial movement along the tubular to secure centralizers in place. In one embodiment of the present invention, an internal spring is provided to induce a hoop stress into the tubular on which the centralizer resides.

A first embodiment of the present invention provides for a centralizer for mounting to the exterior surface of a downhole well tubular. The centralizer has a cylindrical body, an exterior surface, and stabilizing fins extending outwards from the exterior surface. The body has a hollow interior with an interior surface, a first edge, and a second edge formed between the interior and exterior surfaces.

The centralizer has a first ramp formed on the interior surface, proximate to the first edge, and a second ramp formed on the interior surface, proximate to the second edge. A generally helical interior channel is provided on the interior surface extending between the first and second ramps. A first aperture extends between the exterior surface and the first ramp. A second aperture extends between the exterior surface and the second ramp. An expandable spring member is provided, having a first tab at one end and a second tab at its opposite end. The spring is located in the channel. A first retaining pin is removably located in the first aperture for engagement with the first tab. A second retaining pin is removably located in the second aperture for engagement with the second tab.

A second embodiment of the present invention provides for a centralizer for mounting to the exterior surface of a downhole well tubular. The centralizer has a cylindrical body, an exterior surface, and stabilizing fins extending outward from the exterior surface.

The body has a hollow interior with an interior surface and a first edge and a second edge formed between the interior and exterior surfaces. A first ramp is formed on the interior surface proximate to the first edge. A second ramp formed on the interior surface proximate to the second edge. A third ramp is formed on the interior surface between the first and second edges.

A first interior wedge is provided on the interior surface extending circumferentially between the first and third ramps. A second interior wedge is provided on the interior surface extending circumferentially between the second and third ramps. An aperture extends between the exterior surface and the third ramp.

An expandable spring member is provided, having a first helical section and a second helical section connected by a bridge portion. A first tab extends outward from the first helical section and a second tab extends outward from the second helical section. The first helical section is located on the first wedge. The second helical section is located on the second wedge. A retaining pin is removably located in the aperture for engagement with the bridge.

A third embodiment of the present invention provides for a lock collar having the same internal locking system as the second embodiment for a self-locking centralizer described above. The lock collar also has body tabs extending axially outward for engaging the fins of an adjacent centralizer. In this manner, the additional engagement of the lock collar combined with the spring forces prevents axial movement or rotation of the centralizer.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of the embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components. The terms "helical" and "spiral" are not intended to require perfectly mathematical helix or spirals, and are particularly intended to include square ended, closed ended, and ground versions of springs of these types, and also as the channels that would receive any of these shapes.

Figure 1:
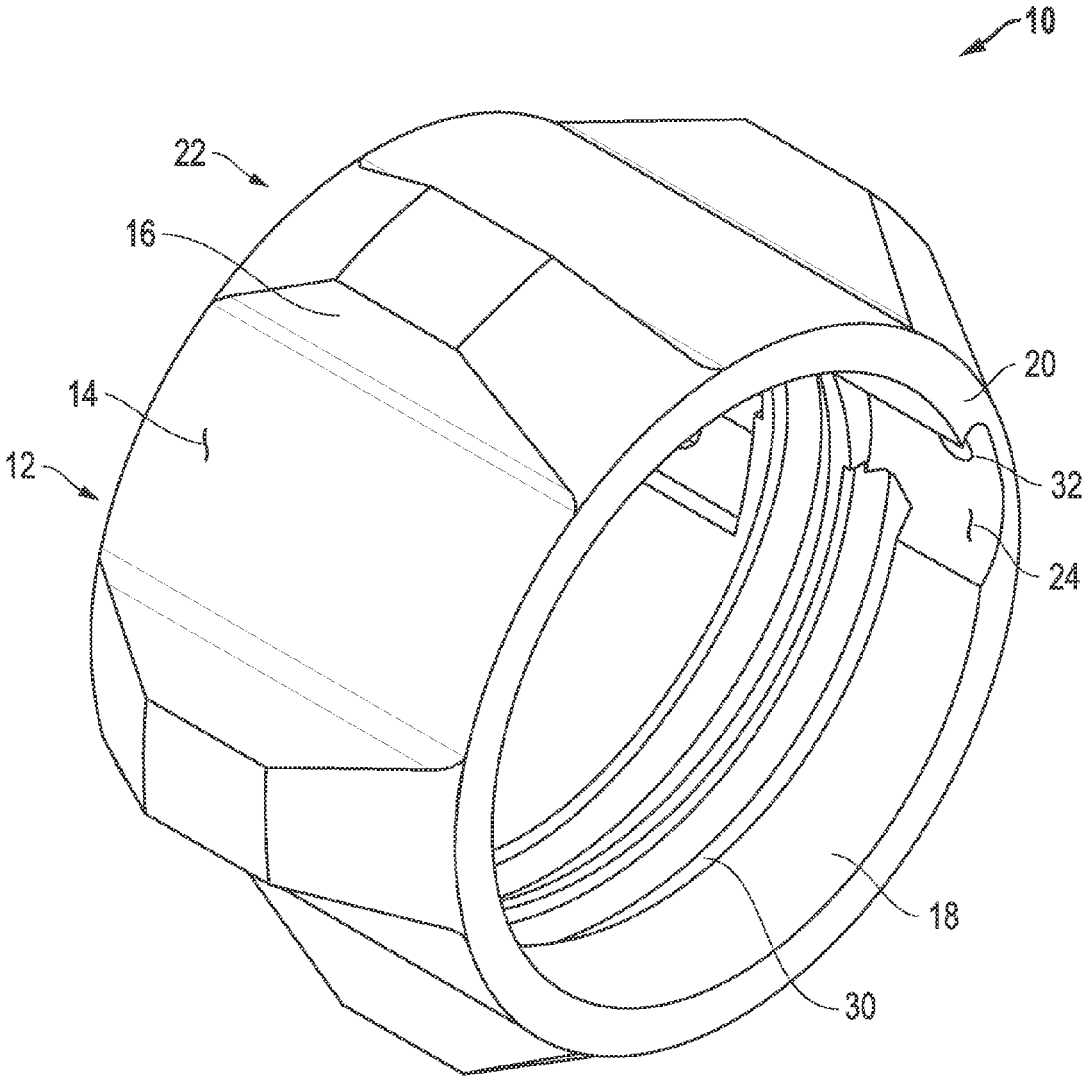
FIG. 1 is an isometric view of an embodiment of a centralizer body illustrated in accordance with principles of the present invention described herein.

FIG. 1 is an isometric view of a first embodiment of a centralizer 10 illustrated in accordance with principles of the present invention described herein. Referring to FIG. 1, centralizer 10 has a cylindrical body 12, comprising an exterior surface 14 and stabilizing fins 16 extending outwards from exterior surface 14. Body 12 has a hollow interior with an interior surface 18, a first edge 20, and a second edge 22 formed between exterior surface 14 and interior surface 18.

A first ramp 24 is formed on interior surface 18, proximate to first edge 20, and a second ramp 26 (see FIG. 3) is formed on interior surface 18, proximate to second edge 22. A generally helical interior channel 30 is provided on interior surface 18, extending between first ramp 24 and second ramp 26. A first aperture 32 extends between exterior surface 14 and first ramp 24. A second aperture 34 (see FIG. 3, aperture 34 shown receiving retaining pin 52) extends between exterior surface 14 and second ramp 26.

Figure 2:
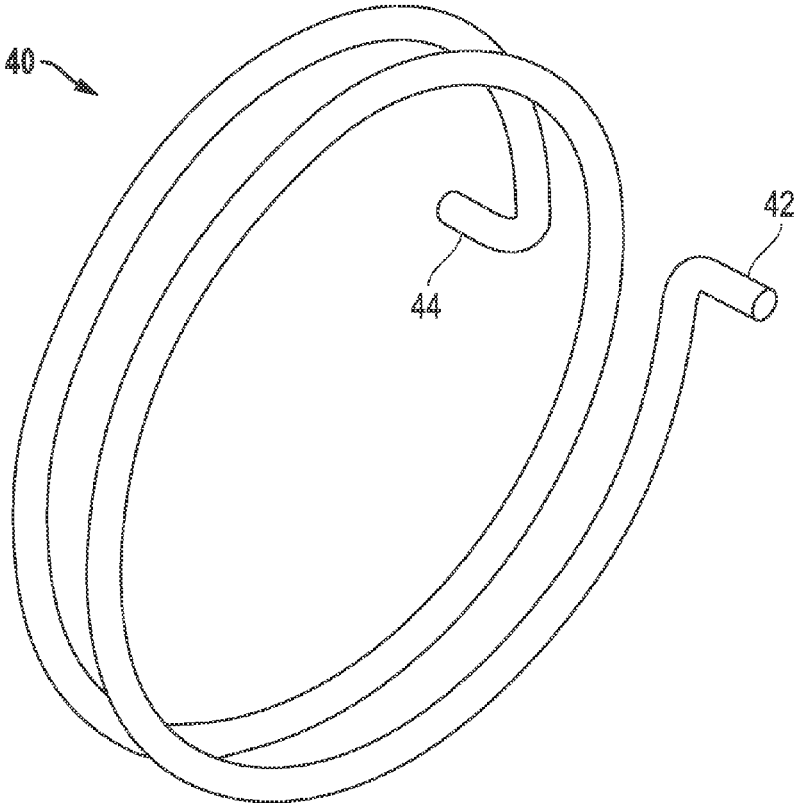
FIG. 2 is an isometric view of a spring member for use with the centralizer body of FIG. 1.

FIG. 2 is an isometric view of a spring member 40 for use with centralizer 10. Expandable spring member 40 is provided with a first tab 42 at one end and a second tab 44 at its opposite end.

Figure 3:
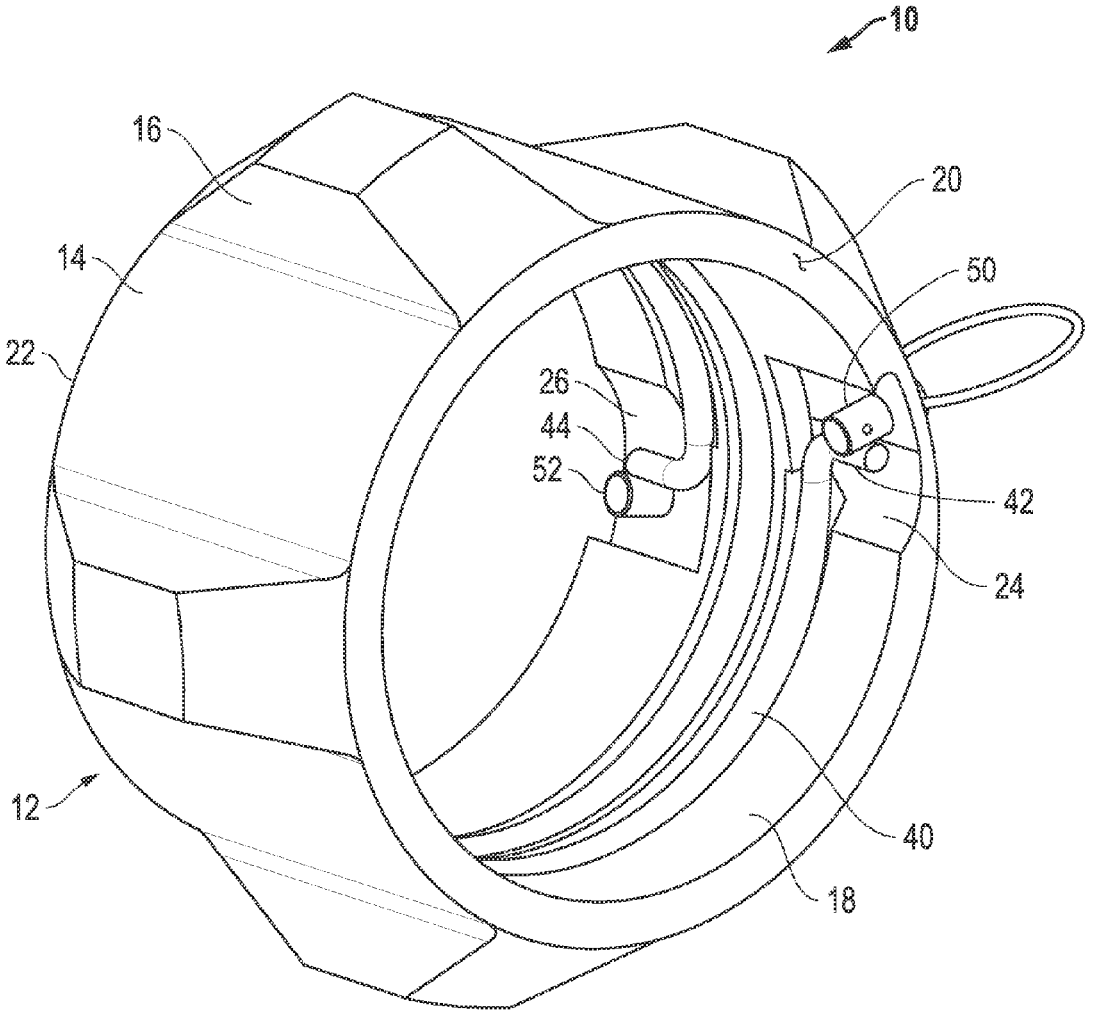
FIG. 3 is an isometric view of the centralizer illustrated with the spring member of FIG. 2 in place.

FIG. 3 is an isometric view of centralizer 10, illustrated with spring member 40 in place. As seen in this view, spring 40 is located in channel 30. A first retaining pin 50 is removably located in first aperture 32 such that retaining pin 50 is in engagement with first tab 42. A second retaining pin 52 is removably located in second aperture 34 for engagement with second tab 44 such that retaining pin 52 is in engagement with second tab 44.

Figure 4:
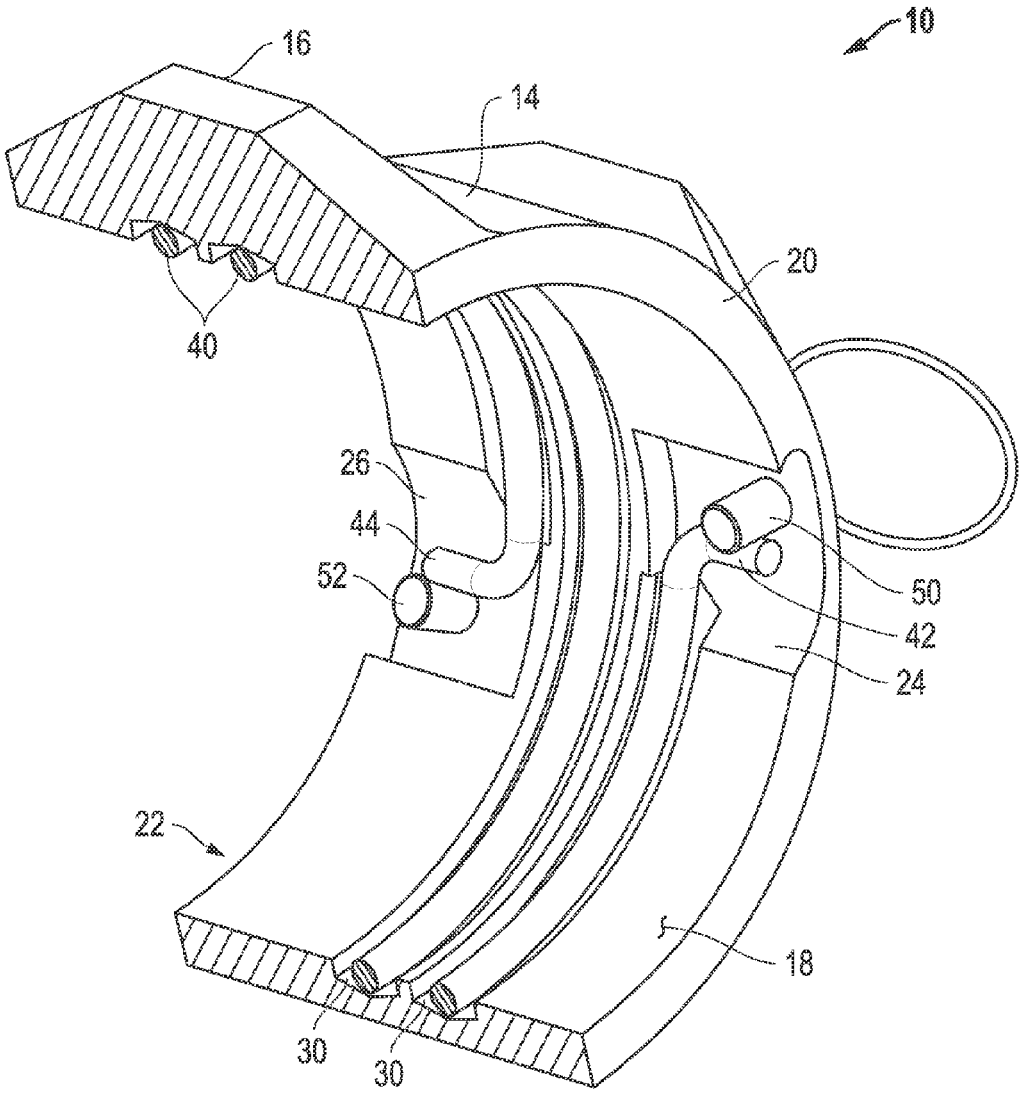
FIG. 4 is an isometric cross-sectional view of the centralizer illustrated with the spring member of FIG. 2 in place.

FIG. 4 is an isometric cross-sectional view of centralizer 10. In this view, the intersection of channel 30 with first ramp 24 and second ramp 26 is readily visible. It is also seen that spring 40 is compressed between retaining pins 50 and 52.

Figure 5:
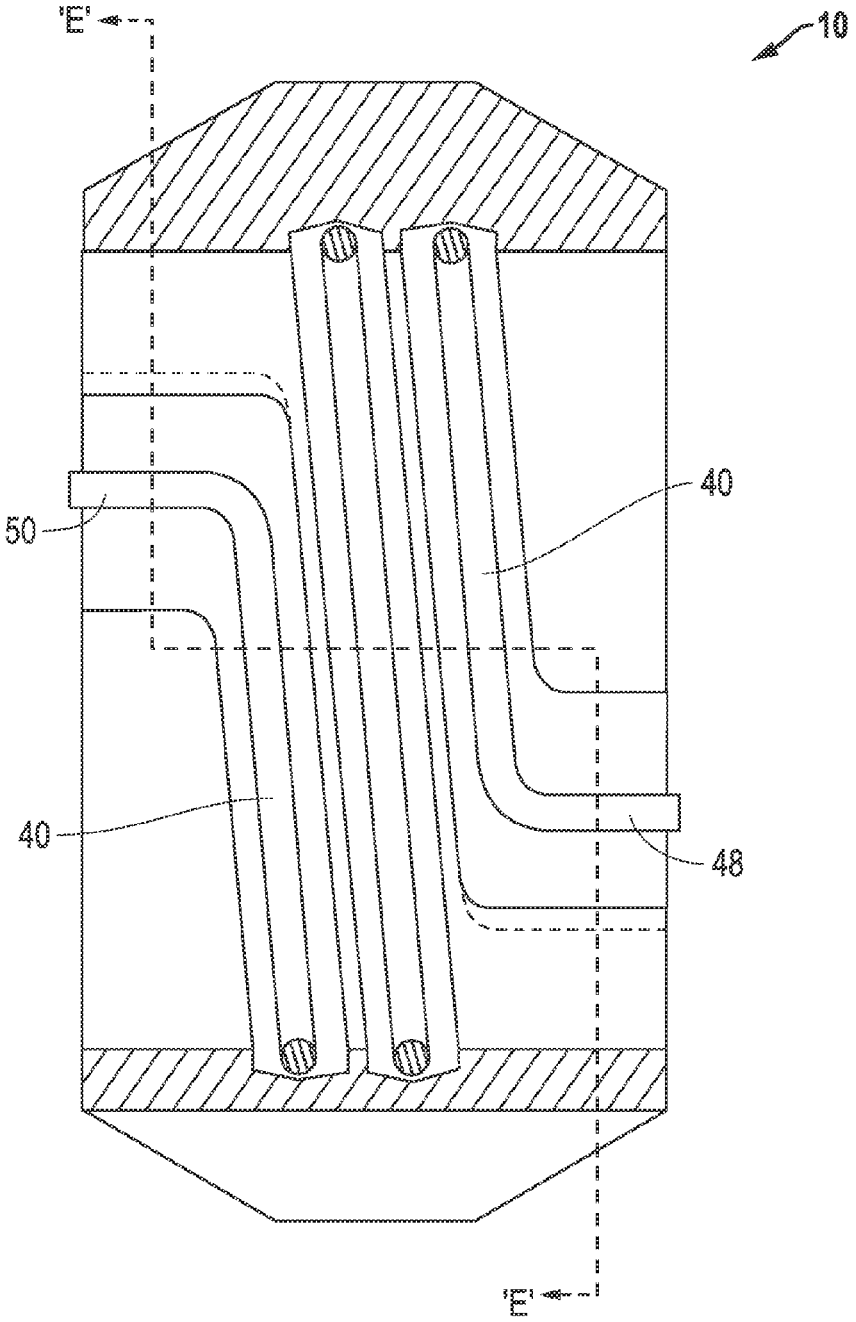
FIG. 5 is a cross-sectional side view of the centralizer that defines a section E-E through which both end positions of the spring may be seen.

FIG. 5 is a cross-sectional side view of centralizer 10 that defines a section E-E through which both end positions of the spring may be seen.

Figure 6:
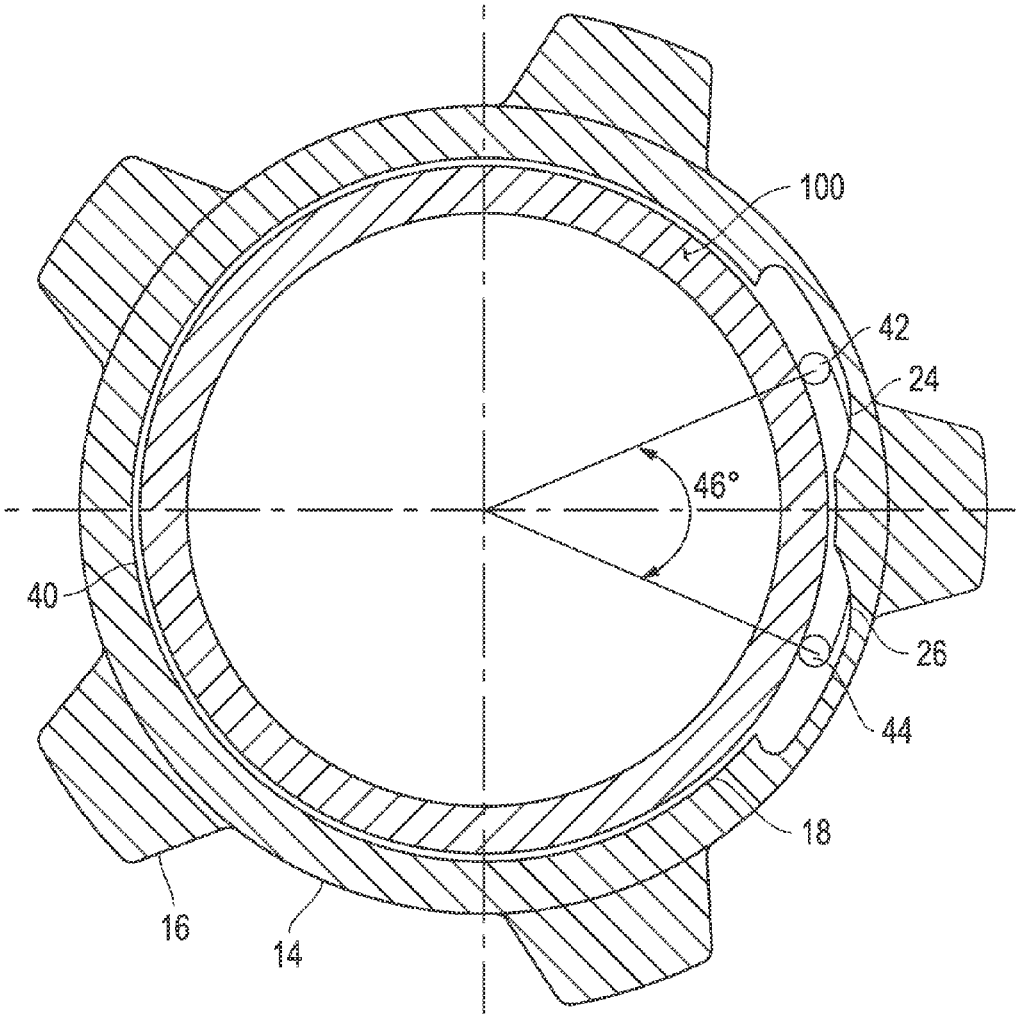
FIG. 6 is an axial cross-section of the centralizer, illustrated as mounted on a tubular, and illustrated inside a wellbore, illustrated at a section line that permits viewing of both ends of the spring member, with the spring in the installed, uncompressed state.

FIG. 6 is an axial cross-section of centralizer 10, illustrated as mounted on tubular 100, illustrated at a section line that permits viewing both tabs 42 and 44 of spring member 40 in relationship to slopes 24 and 26, respectively. In this embodiment an exemplary angle of 46 degrees is provided between first tab 42 and second tab 44. As seen in FIG. 6, rotation in either direction will have the result of further securing centralizer 10 against tubular 100.

Figure 7:
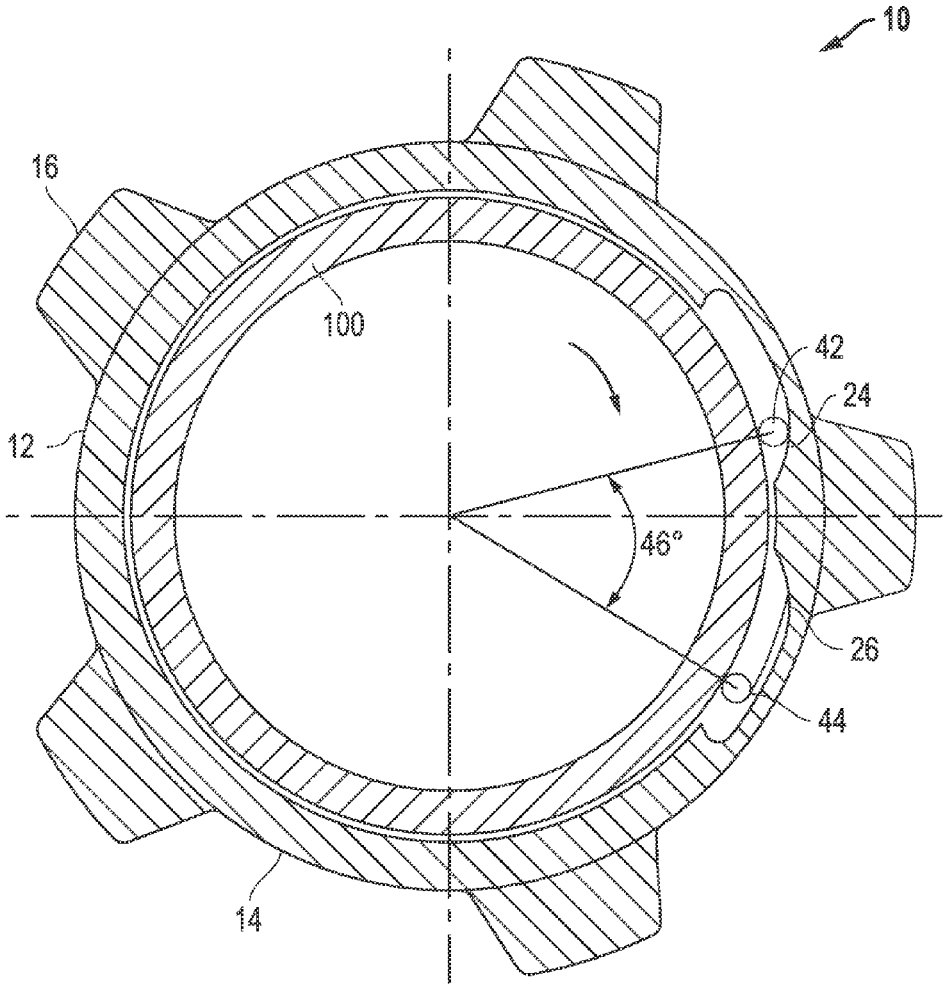
FIG. 7 is an axial cross-section of the centralizer, illustrated as mounted on a tubular, illustrated at a section line that permits viewing of both ends of the spring member, shown with the centralizer rotated counterclockwise and loading the spring against the internal wedge surface.

FIG. 7 is another axial cross-section of centralizer 10, illustrated as mounted on tubular 100, illustrated at section line E-E, shown with tubular 100 rotated clockwise (centralizer 10 rotated relatively counterclockwise) and loading spring tab 42 against ramp 24 to limit additional relative rotation between tubular 100 and centralizer 10.

Figure 8:
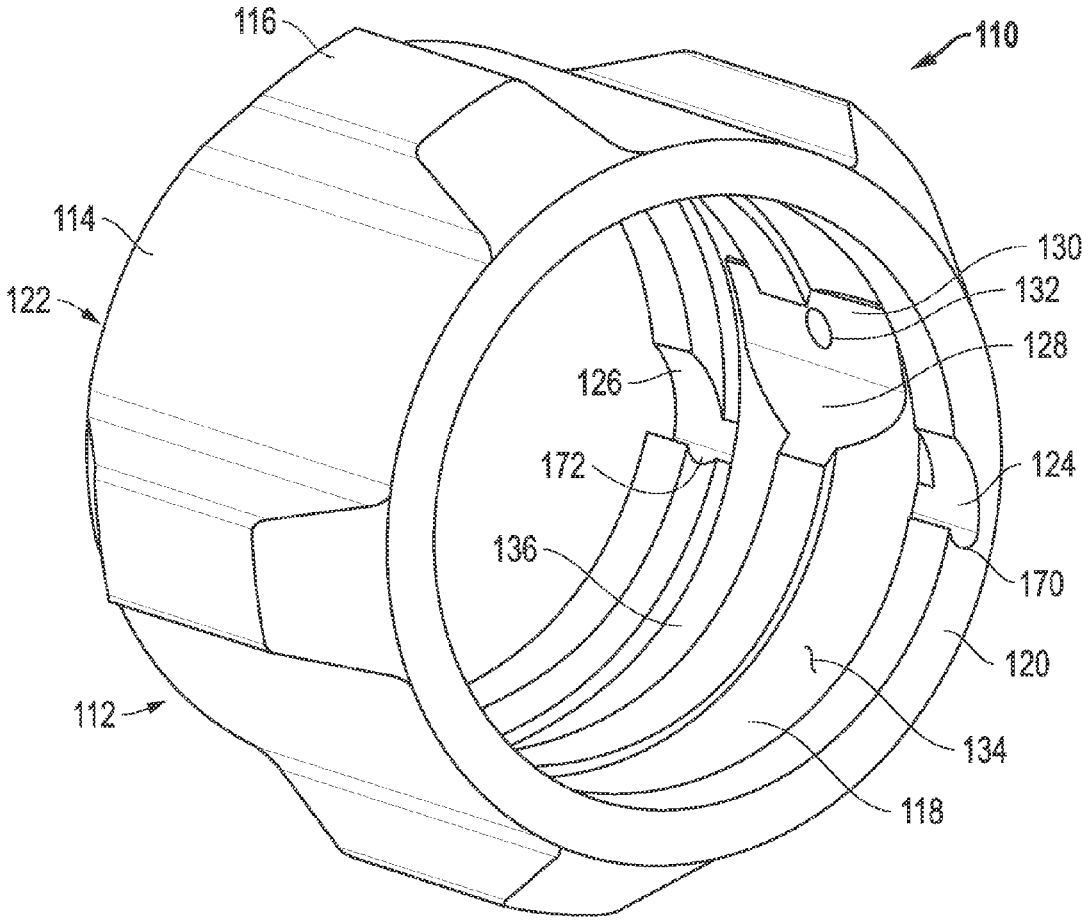
FIG. 8 is an isometric view of a second embodiment of a centralizer body illustrated in accordance with principles of the present invention described herein.

FIG. 8 is an isometric view of a second embodiment of a centralizer body 110 illustrated in accordance with principles of the present invention described herein. Referring to FIG. 8, centralizer 110 has a cylindrical body 112, comprising an exterior surface 114 and stabilizing fins 116 extending outwards from exterior surface 114. Body 112 has a hollow interior with an interior surface 118, a first edge 120, and a second edge 122 formed between exterior surface 114 and interior surface 118.

A first ramp 124 is formed on interior surface 118, proximate to first edge 120, and a second ramp 126 is formed on interior surface 118, proximate to second edge 122. A first ramp 124 is formed on interior surface 118, proximate to first edge 120. A second ramp 126 is formed on interior surface 118, proximate to second edge 126.

At the position where first ramp 124 engages side 120, a first slot 170 is formed. A second slot 172 is formed where second ramp 126 engages side 122.

A third ramp 128 is centrally formed on interior surface 118. A first interior circumferential wedge 134 is formed on interior surface 118, and extends between first ramp 124 and third ramp 128. A second interior circumferential wedge 136 is formed on interior surface 118 and extends between second ramp 126 and third ramp 128. An aperture extends between exterior surface 112 and third ramp 128.

Figure 9:
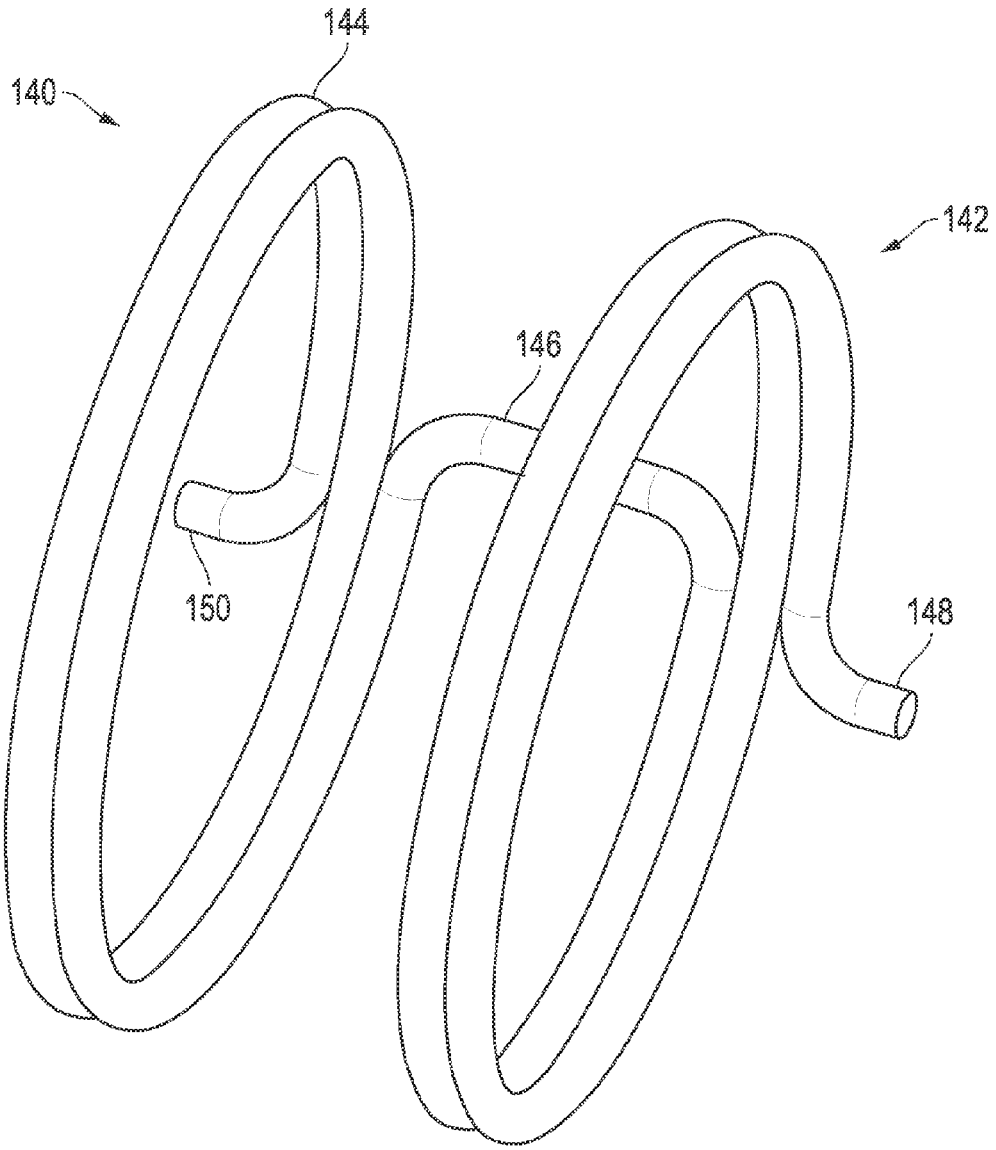
FIG. 9 is an isometric view of a spring member for use with the centralizer of FIG. 8.

FIG. 9 is an isometric view of a spring member 140 for use with centralizer 110 of FIG. 8. Expandable spring member 140 has a first helical section 142 and a second helical section 144 connected by a bridge portion 146. A first tab 148 extends outward from first helical section 142. A second tab 150 extends outward from second helical section 144.

Figure 10:
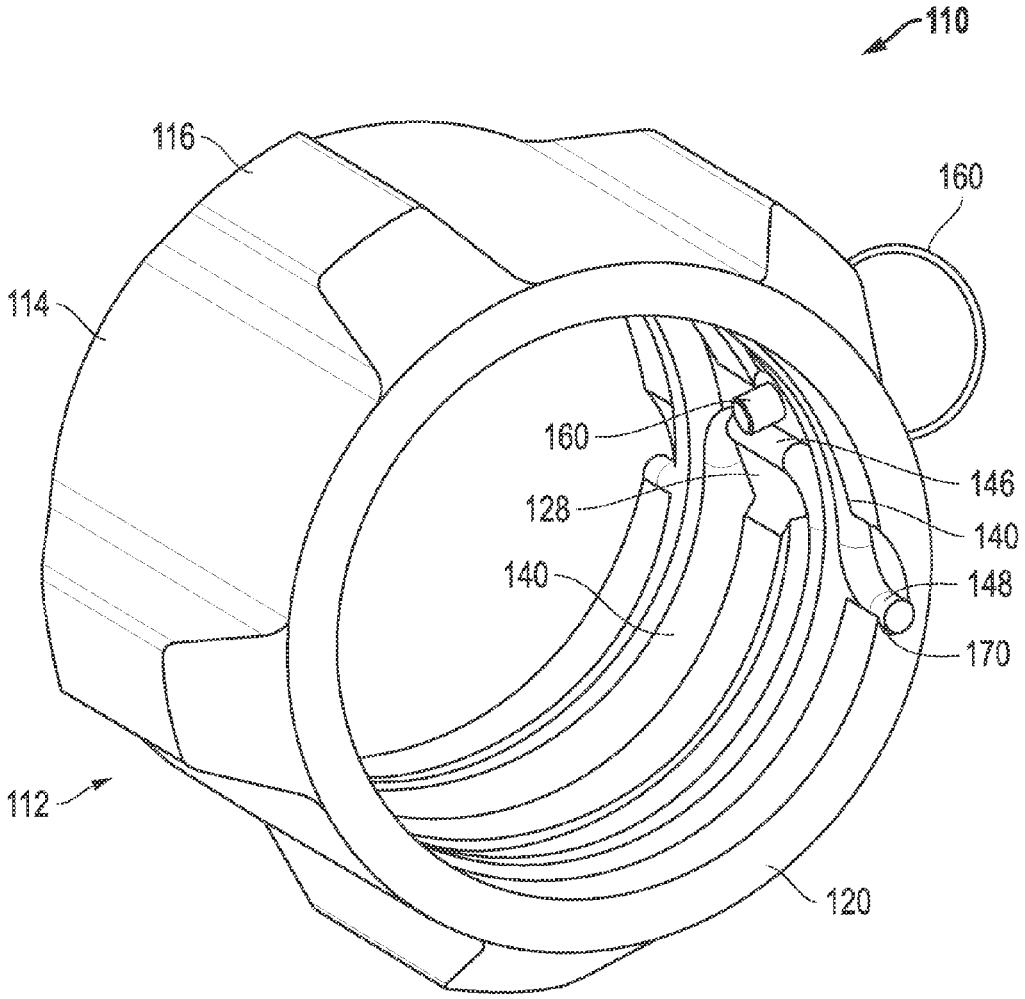
FIG. 10 is an isometric view of the centralizer illustrated with the spring member of FIG. 9 in place.
Figure 11:
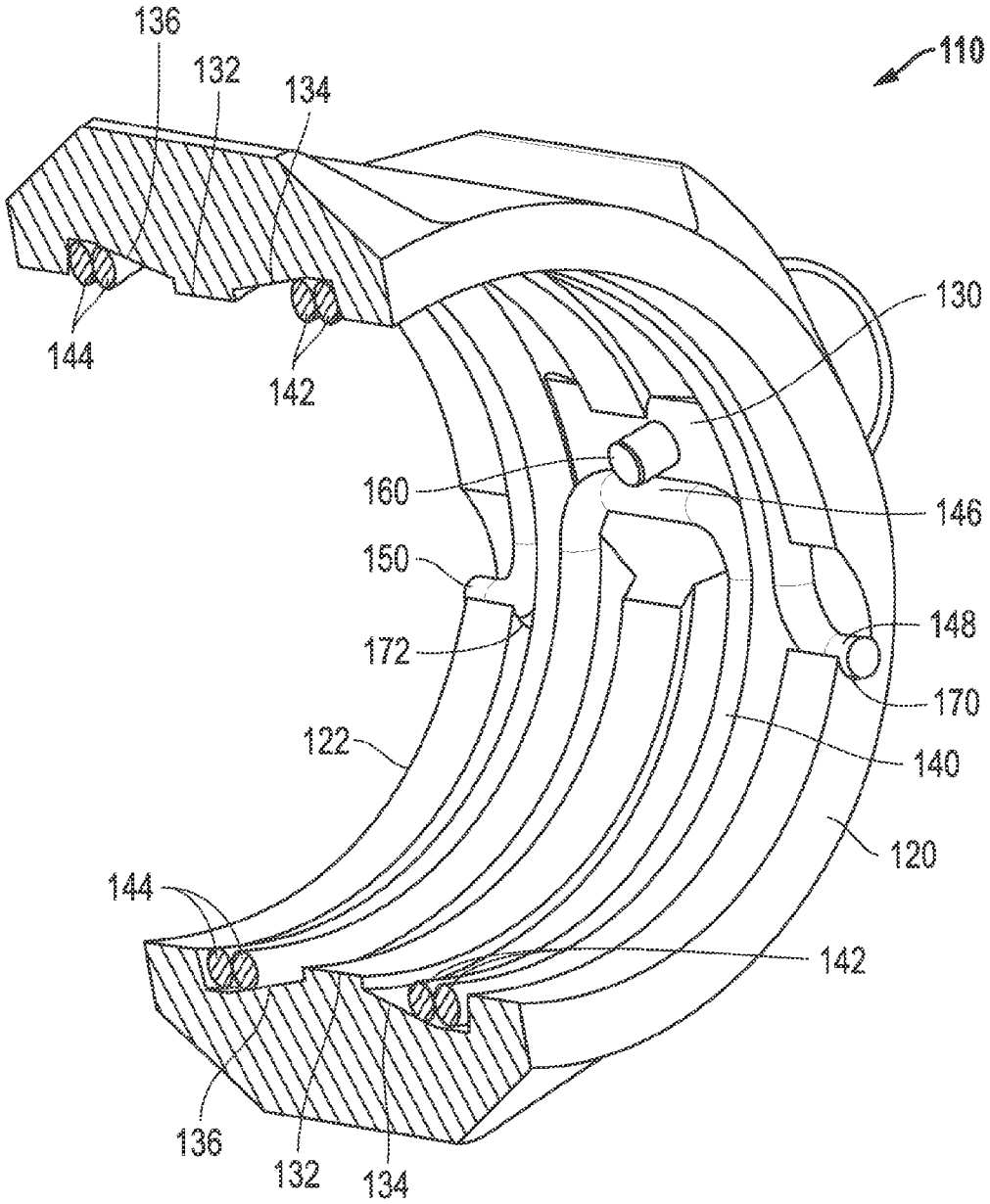
FIG. 11 is an isometric cross-sectional view of the centralizer illustrated with the spring of FIG. 9 in place.

FIG. 10 is an isometric view of centralizer 110 illustrated with spring member 140 of FIG. 9 in place. FIG. 11 is an isometric cross-sectional view of centralizer 110 as illustrated in FIG. 10.

Referring to FIGS. 10 and 11, it is seen that first helical section 142 is located on first wedge 134. Second helical section 144 is located on second wedge 136. A retaining pin 160 is removably located in aperture 136 for engagement with bridge 146 of spring 140. As will be seen in FIGS. 9 and 10, slots 170 and 172 provide a rotational limit for spring 140 when pretensioning spring member 140 against retaining pin 160.

Figure 12:
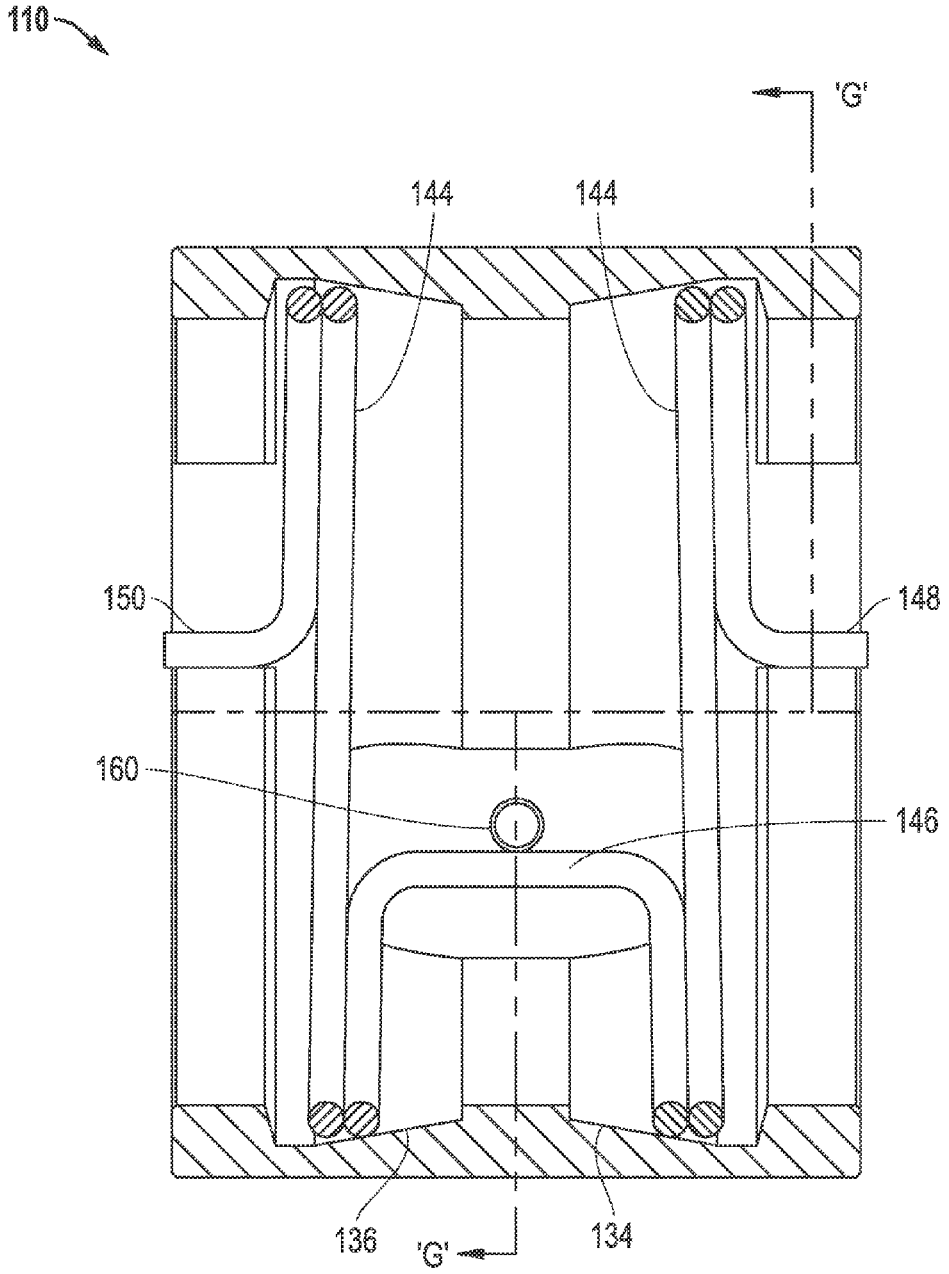
FIG. 12 is a cross-sectional side view of the centralizer of FIGS. 8-11.

FIG. 12 is a cross-sectional side view of centralizer 110. In summary of the operation, when retainer pin 160 is removed, spring 140 is preloaded against the surface of tubular 100, holding it in place. This prevents axial movement of centralizer 110 relative to tubular 100. Clockwise rotation of tubular 100 relative to centralizer 110 engages tab 148 between first ramp 124 and tubular 100 to limit further rotation. Counterclockwise rotation of tubular 100 relative to centralizer 110 engages tab 150 between second ramp 126 and tubular 100 to limit further rotation. The surface of spring 140 may be knurled or profiled to increase resistance to sliding relative to tubular 100.

Figure 13:
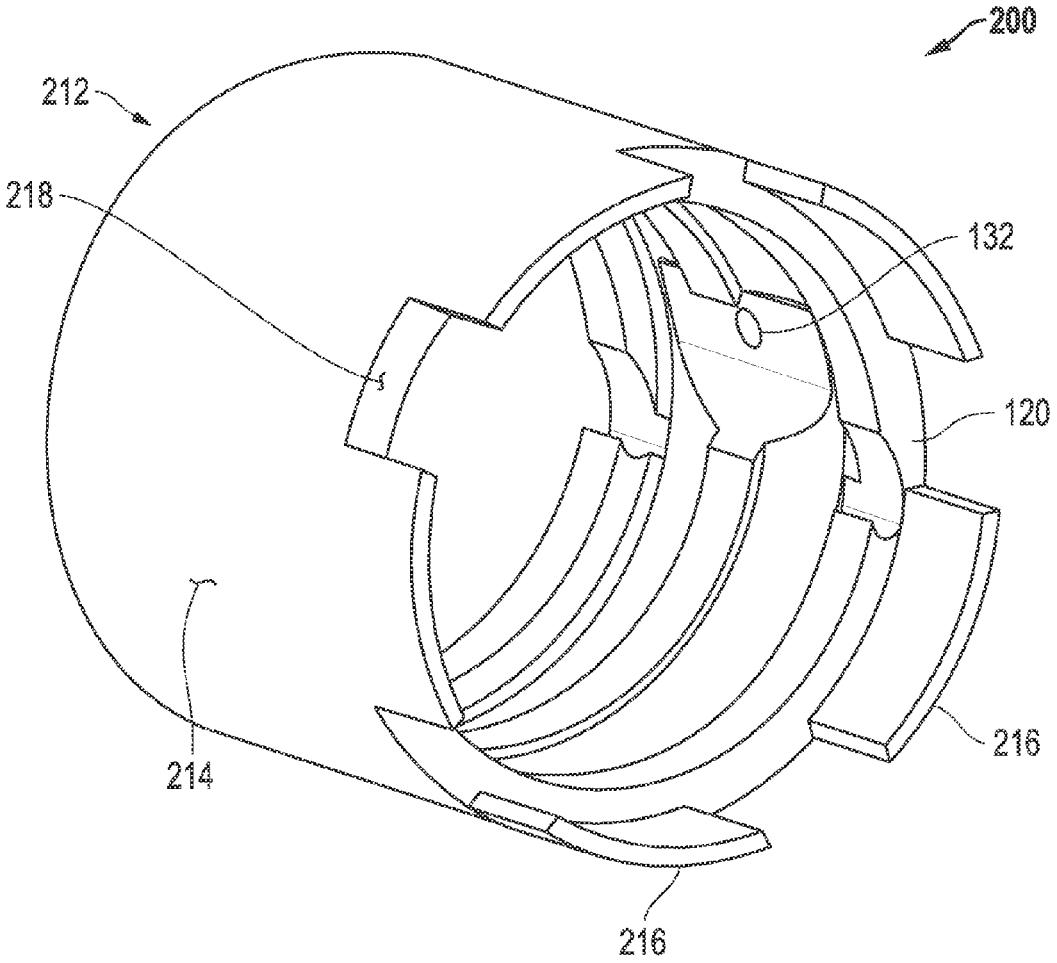
FIG. 13 is an isometric view of a third embodiment, being for a lock collar.

FIG. 13 is an isometric view of a third embodiment, being for a lock collar 200. Lock collar 200 has all the same internal configurations of the self-locking centralizer 110 described in the preceding paragraphs, and these components are occasionally numbered the same for reference purposes, but will not otherwise be described herein as their design and operation is the same.

FIG. 13 is an illustration of a body 212 of lock collar 200. Body 212 has an external surface 214 and a plurality of body tabs 216 extending outward from one end thereof. Body tabs 216 are separated by intermittent body slots 218.

Figure 14:
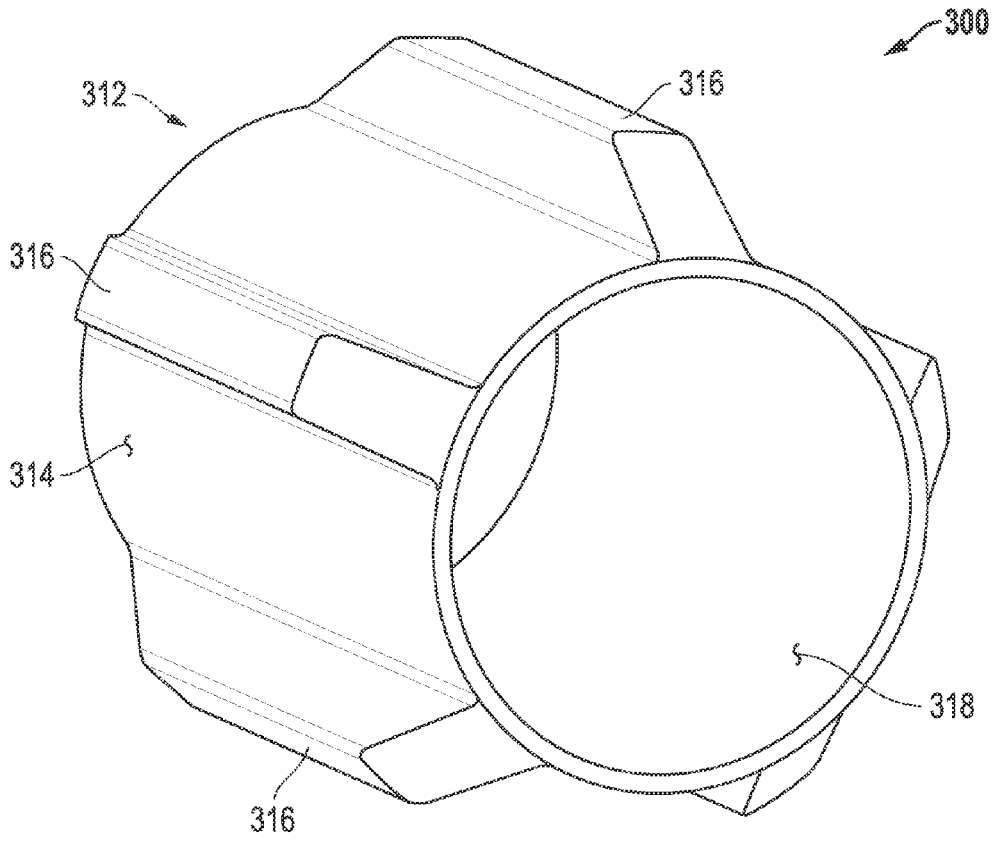
FIG. 14 is an isometric view for the centralizer.

FIG. 14 is an isometric view for a conventional centralizer 300. Centralizer 300 has a cylindrical body 312, comprising an exterior surface 314 and stabilizing fins 316 extending outward from exterior surface 314. Body 312 has a hollow interior with an interior surface 318 for fitting over a tubular 100 (not shown).

Figure 15:
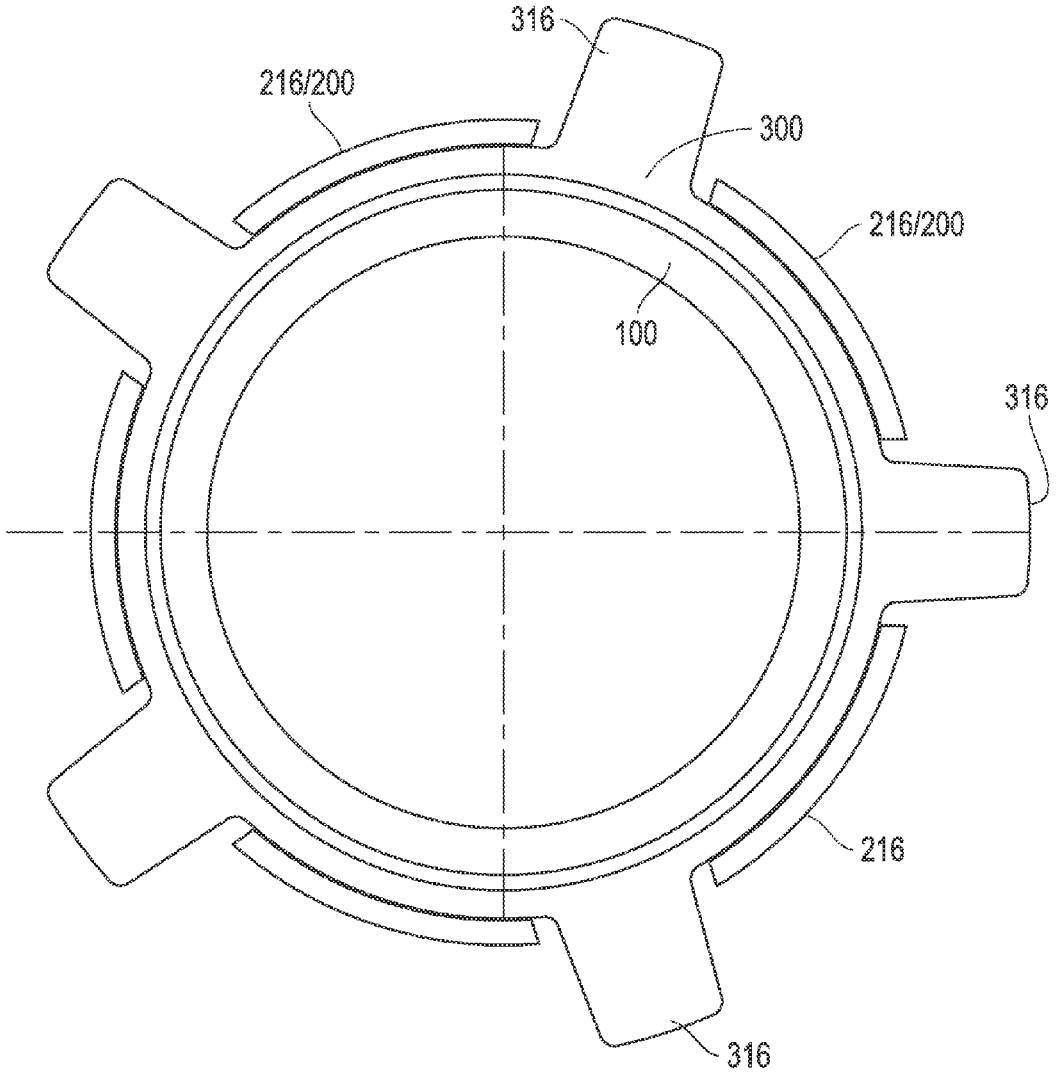
FIG. 15 is an end view of the lock collar mounted on the centralizer.

FIG. 15 is an end view of lock collar 200 mounted on centralizer 300, illustrating body tabs 216 positioned over exterior surface 314 of centralizer 300 and between stabilizing fins 316 of centralizer 300. In this position, stabilizing fins 316 are engaged with body slots 218 of lock collar 200.

Figure 16:
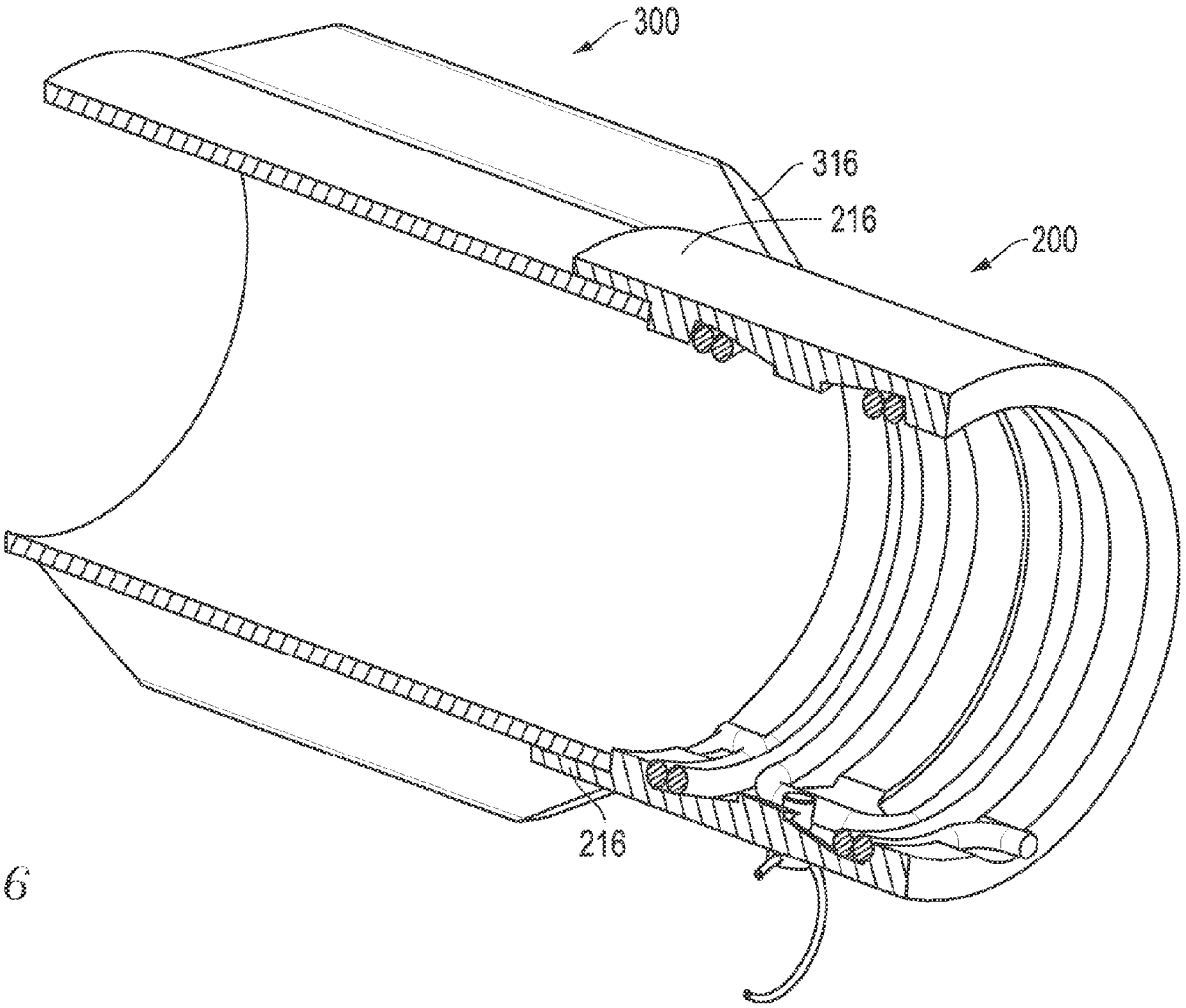
FIG. 16 an isometric view of the lock collar mounted on the centralizer.

FIG. 16 an isometric view of lock collar 200 mounted on centralizer 300. The internal locking system of lock collar 200 secures lock collar 200 to tubular 100. The engagement of lock collar 200 with stabilizing fins 316 of centralizer 300 works to prevent rotation of centralizer 300 relative to lock collar 200 and tubular 100.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A lock collar for mounting to the exterior surface of a downhole well tubular and for engaging with an adjacent centralizer, said lock collar comprising:

a cylindrical body comprising a hollow interior with an interior surface, a first edge and a second edge formed between said interior surface and said exterior surface, and a plurality of body tabs extending outward from at least one of said first edge and said second edge, said plurality of body tabs separated by body slots, said plurality of body tabs configured to engage with an adjacent centralizer when said lock collar is mounted to said exterior surface of said downhole well tubular;

a first ramp formed on said interior surface, proximate to said first edge;

a second ramp formed on said interior surface, proximate to said second edge;

a first slot disposed adjacent said first ramp;

a second slot disposed adjacent said second ramp;

a third ramp formed on said interior surface;

a first interior wedge on said interior surface extending between said first ramp and said third ramp;

a second interior wedge on said interior surface extending between said second ramp and said third ramp;

an aperture extending between said exterior surface of said cylindrical body and said third ramp;

an expandable spring member having a first helical section and a second helical section connected by a bridge portion;

a first tab extending outward from the first helical section, said first tab having a first position wherein said first tab is engaged by said first slot, and said first tab having a second position wherein said first tab is loaded against said first ramp to limit rotation between said lock collar and said exterior surface of said downhole well tubular, and wherein said lock collar also limits rotation of said adjacent centralizer engaged with said lock collar by said body tabs of said lock collar;

a second tab extending outward from the second helical section, said second tab having a first position wherein said second tab is engaged by said second slot, and said second tab having a second position wherein said second tab is loaded against said second ramp to limit rotation between said lock collar and said exterior surface of said downhole well tubular, and wherein said lock collar also limits rotation of said adjacent centralizer engaged with said lock collar by said body tabs of said lock collar;

said first helical section located on the first wedge;

said second helical section located on the second wedge; and, a retaining pin removably located in the aperture for engagement with the bridge portion, said bridge portion having a first position wherein said bridge portion is engaged by said retaining pin, and said bridge portion having a second position wherein said bridge portion is loaded against said third ramp to limit rotation between said lock collar and said exterior surface of said downhole well tubular, and wherein said lock collar also limits rotation of said adjacent centralizer engaged with said lock collar by said body tabs of said lock collar.

2. The lock collar of claim 1 further comprising:

wherein said expandable spring member is held in an expanded state by said retaining pin, such that said lock collar may be placed over said exterior surface of said downhole well tubular.

3. The lock collar of claim 2 further comprising:

wherein said retaining pin is removable from said exterior surface of said lock collar.

4. The lock collar of claim 2 further comprising:

wherein an interior diameter of said expandable spring member, in an unexpanded state, is less than an exterior diameter of said downhole well tubular over which said lock collar will be located, and, wherein an interior diameter of said expandable spring member, in an expanded state, is equal to or greater than said exterior diameter of said downhole well tubular over which said lock collar will be located.

5. The lock collar of claim 2 further comprising:

a surface of said expandable spring member being treated or knurled to increase resistance to sliding.

6. A lock collar for mounting to the exterior surface of a downhole well tubular and for engaging with an adjacent centralizer, said lock collar comprising:

a cylindrical body comprising a hollow interior with an interior surface, a first edge and a second edge formed between said interior surface and said exterior surface, and a plurality of body tabs extending outward from at least one of said first edge and said second edge, said plurality of body tabs separated by body slots, said plurality of body tabs configured to engage with an adjacent centralizer when said lock collar is mounted to said exterior surface of said downhole well tubular;

an expandable spring member coupled to said interior surface of cylindrical body, said expandable spring member disposed to limit rotation between said lock collar and said exterior surface of said downhole well tubular, and wherein said lock collar also limits rotation of said adjacent centralizer engaged with said lock collar by said body tabs of said lock collar;

a first ramp formed on said interior surface, proximate to said first edge;

a second ramp formed on said interior surface, proximate to said second edge;

a first slot disposed adjacent said first ramp;

a second slot disposed adjacent said second ramp;

a third ramp formed on said interior surface;

a first interior wedge on said interior surface extending between said first ramp and said third ramp;

a second interior wedge on said interior surface extending between said second ramp and said third ramp;

an aperture extending between said exterior surface of said cylindrical body and said third ramp;

said expandable spring member having a first helical section and a second helical section connected by a bridge portion;

a first tab extending outward from the first helical section, said first tab having a first position wherein said first tab is engaged by said first slot, and said first tab having a second position wherein said first tab is loaded against said first ramp to limit rotation between said lock collar and said exterior surface of said downhole well tubular, and wherein said lock collar also limits rotation of said adjacent centralizer engaged with said lock collar by said body tabs of said lock collar;

a second tab extending outward from the second helical section, said second tab having a first position wherein said second tab is engaged by said second slot, and said second tab having a second position wherein said second tab is loaded against said second ramp to limit rotation between said lock collar and said exterior surface of said downhole well tubular, and wherein said lock collar also limits rotation of said adjacent centralizer engaged with said lock collar by said body tabs of said lock collar;

said first helical section located on the first wedge;

said second helical section located on the second wedge; and, a retaining pin removably located in the aperture for engagement with the bridge portion, said bridge portion having a first position wherein said bridge portion is engaged by said retaining pin, and said bridge portion having a second position wherein said bridge portion is loaded against said third ramp to limit rotation between said lock collar and said exterior surface of said downhole well tubular, and wherein said lock collar also limits rotation of said adjacent centralizer engaged with said lock collar by said body tabs of said lock collar.

7. The lock collar of claim 6 further comprising:

wherein said expandable spring member is held in an expanded state by said retaining pin, such that said lock collar may be placed over said exterior surface of said downhole well tubular.

8. The lock collar of claim 6 further comprising:

wherein said retaining pin is removable from said exterior surface of said lock collar.

9. The lock collar of claim 6 further comprising:

wherein an interior diameter of said expandable spring member, in an unexpanded state, is less than an exterior diameter of said downhole well tubular over which said lock collar will be located, and, wherein an interior diameter of said expandable spring member, in an expanded state, is equal to or greater than said exterior diameter of said downhole well tubular over which said lock collar will be located.

10. The lock collar of claim 6 further comprising:
a surface of said expandable spring member being treated or knurled to increase resistance to sliding.

* * * * *